US007411573B2

(12) United States Patent
Willis

(10) Patent No.: US 7,411,573 B2
(45) Date of Patent: Aug. 12, 2008

(54) LCOS COLUMN MEMORY EFFECT REDUCTION

(75) Inventor: Donald Henry Willis, Indianapolis, IN (US)

(73) Assignee: Thomson Licensing, Boulogne-Billancourt (FR)

( * ) Notice: Subject to any disclaimer, the term of this patent is extended or adjusted under 35 U.S.C. 154(b) by 118 days.

(21) Appl. No.: 10/479,950

(22) PCT Filed: Jun. 6, 2002

(86) PCT No.: PCT/US02/18030

§ 371 (c)(1),
(2), (4) Date: Dec. 8, 2003

(87) PCT Pub. No.: WO02/101710

PCT Pub. Date: Dec. 19, 2002

(65) Prior Publication Data

US 2004/0169754 A1 Sep. 2, 2004

Related U.S. Application Data

(60) Provisional application No. 60/297,130, filed on Jun. 8, 2001.

(51) Int. Cl.
*G09G 3/36* (2006.01)

(52) U.S. Cl. ..... 345/100; 345/87; 345/89; 345/90; 345/92

(58) Field of Classification Search ..... 345/87–103, 345/147, 205, 211, 50–55, 204, 91, 84, 107, 345/76, 79; 349/172; 358/213.26, 88, 213, 358/26, 38; 365/63; 250/208.1; 359/621, 359/22; 382/149; 350/333
See application file for complete search history.

(56) References Cited

U.S. PATENT DOCUMENTS 4,345,249 A * 8/1982 Togashi ..... 345/103
4,675,739 A * 6/1987 Catchpole et al. ..... 378/98.8
4,686,374 A * 8/1987 Liptay-Wagner et al. ..... 250/559.46
4,743,096 A * 5/1988 Wakai et al. ..... 345/89

(Continued)

FOREIGN PATENT DOCUMENTS

EP 0 848 368 6/1998

OTHER PUBLICATIONS

Search Report.

*Primary Examiner*—Prabodh Dharia
(74) *Attorney, Agent, or Firm*—Joseph J. Laks; Harvey D. Fried; Sammy S. Henig

(57) ABSTRACT

The invention concerns a method for reducing the effect of column memory. The method includes the steps of activating one of a plurality of row electrodes, selectively applying a video input signal to a plurality of column electrodes, and setting at least one of the plurality of column electrodes to a substantially constant voltage prior to activating a subsequent row electrode. In one arrangement, the substantially constant voltage can correlate to a flat field. The method can also include repeating the steps of activating one of the plurality of row electrodes step, selectively applying the video input signal step, and setting at least one of the plurality of column electrodes to the substantially constant voltage step in which the steps can be performed in a liquid crystal on silicon imager.

32 Claims, 3 Drawing Sheets

U.S. PATENT DOCUMENTS 4,837,566 A * 6/1989 Channing et al. ..... 345/76
4,942,473 A * 7/1990 Zeevi et al. ..... 348/281
4,945,407 A * 7/1990 Winnek ..... 348/59
5,093,654 A 3/1992 Swift et al.
5,159,325 A * 10/1992 Kuijk et al. ..... 345/84
5,412,397 A * 5/1995 Kanatani et al. ..... 345/99
5,451,978 A * 9/1995 Harju ..... 345/78
5,467,105 A * 11/1995 Verhulst et al. ..... 345/87
5,619,225 A * 4/1997 Hashimoto ..... 345/98
5,739,803 A * 4/1998 Neugebauer ..... 345/98
5,781,258 A * 7/1998 Dabral et al. ..... 349/73
5,786,797 A * 7/1998 Kapoor et al. ..... 345/79
5,805,121 A * 9/1998 Burgan et al. ..... 345/50
5,812,106 A * 9/1998 Hughes ..... 345/90
5,909,026 A * 6/1999 Zhou et al. ..... 250/208.1
5,959,598 A 9/1999 McKnight ..... 345/90
5,959,747 A * 9/1999 Psaltis et al. ..... 359/22
5,999,150 A * 12/1999 Nighan et al. ..... 345/79
6,023,278 A * 2/2000 Margolin ..... 345/419
6,046,790 A * 4/2000 Hara et al. ..... 349/172
6,059,718 A * 5/2000 Taniguchi et al. ..... 600/117
6,067,062 A * 5/2000 Takasu et al. ..... 345/87
6,124,974 A * 9/2000 Burger ..... 359/621
6,184,851 B1 * 2/2001 Yamaguchi et al. ..... 345/75.2
6,262,701 B1 * 7/2001 Okuda et al. ..... 345/74.1
6,271,816 B1 * 8/2001 Jeong et al. ..... 345/87
6,271,817 B1 * 8/2001 Wakai et al. ..... 345/91
6,608,620 B1 * 8/2003 Suzuki et al. ..... 345/204
6,700,562 B1 * 3/2004 Knapp et al. ..... 345/98
6,816,145 B1 * 11/2004 Evanicky ..... 345/102
6,897,855 B1 * 5/2005 Matthies et al. ..... 345/204
7,106,380 B2 * 9/2006 Willis ..... 348/459
2001/0040537 A1 * 11/2001 Sakai et al. ..... 345/55
2002/0126218 A1 * 9/2002 Willis ..... 348/459
2003/0072172 A1 * 4/2003 Somasekhar et al. ..... 365/63
2003/0112210 A1 * 6/2003 Ito et al. ..... 345/87
2003/0215129 A1 * 11/2003 Yang et al. ..... 382/149
2004/0041773 A1 * 3/2004 Takeda et al. ..... 345/98
2005/0122284 A1 * 6/2005 Gates et al. ..... 345/60
2005/0157238 A1 * 7/2005 Yanagawa et al. ..... 349/139
2005/0179642 A1 * 8/2005 Wilcox et al. ..... 345/107
2006/0097991 A1 * 5/2006 Hotelling et al. ..... 345/173
2006/0279501 A1 * 12/2006 Lu et al. ..... 345/94

* cited by examiner

LCOS COLUMN MEMORY EFFECT REDUCTION

CROSS REFERENCE TO RELATED APPLICATIONS

This application claims the benefit under 35 U.S.C. §365 of International Application PCT/US02/18030 filed Jun. 6, 2002, which claims the benefit of U.S. Provisional Application No. 60/297,130 filed Jun. 8, 2001.

BACKGROUND OF THE INVENTION

1. Field of the Invention

The inventive arrangements relate generally to the field of projection television receivers and displays and more particularly to projection television receivers and displays that employ imagers such as liquid crystal on silicon imagers.

2. Description of Related Art

There have been many new developments in various types of electronic displays and video imaging devices. One example of such technology is liquid crystal on silicon (LCOS). As is known in the art, an LCOS imager generally contains an array of row and column electrodes such that the pixels of the LCOS imager can be addressed by selection of these row and column electrodes.

Typically, a video input signal is selectively fed to each of the column electrodes, and selection of a row electrode enables each cell corresponding with the pixels to be charged to a desired pixel voltage. This permits video to be written to each of the rows of pixels. The video input signal is transferred to the column electrodes from a bus and through a number of switches connected to the bus and the column electrodes. These switches remain closed only for brief periods of time. A particular cell remains lighted with the same intensity until the video input signal changes that cell thereby acting as a sample and hold. That is, the pixel does not decay, as is the case with the phosphors in a cathode ray tube. Notably, many imagers permit the row electrodes to be selected in a sequential fashion, and some permit the row electrodes to be selected in a non-sequential manner.

Current LCOS imagers, however, suffer from a significant drawback known as column memory. As the video input signal is transferred to a column electrode and the switch through which the input signal is passing opens, a charge remains on the column electrode. Thus, when the next row electrode is activated, the charge that is left over from the previous charging of the column electrode remains on the column electrode until the switch is closed again to write video to the new row of pixels. This residual charge can result in scene content from the previously written row being displayed in the new row being written thereby causing a phenomenon known as "ghosting." The ghosting effect can be particularly troublesome if rows are selected in a non-sequential manner, as the voltage levels on the column electrodes from the previous row selection may be significantly different from the current row selection. Thus, it is desirable to eliminate the ghosting effect without significantly increasing system costs or complexity.

SUMMARY

The present invention concerns a method for reducing the effect of column memory. The method includes the steps of activating one of a plurality of row electrodes, selectively applying a video input signal to a plurality of column electrodes, and setting at least one of the plurality of column electrodes to a substantially constant voltage prior to activating a subsequent row electrode. In one arrangement, the substantially constant voltage can correlate to a flat field.

In another arrangement, the method can further include repeating the step of activating one of the plurality of row electrodes, repeating the step of selectively applying the video input signal, and repeating the step of setting at least one of the plurality of column electrodes to a substantially constant voltage. These steps can be performed in a liquid crystal on silicon imager. In addition, at least a portion of the activating steps can be performed sequentially or non-sequentially. The activating step can further include the step of activating a row electrode associated with an active display line.

In one aspect, the step of setting at least one of the plurality of column electrodes to a substantially constant voltage can further include the steps of writing the video input signal to a memory, activating the subsequent row electrode once the plurality of column electrodes are set to the substantially constant voltage, and selectively applying the video input signal from the memory to the plurality of column electrodes. In another aspect, the step of setting at least one of the plurality of column electrodes to a substantially constant voltage can further include the step of activating a subsequent row electrode associated with a hidden display line such that a substantially constant brightness associated with the substantially constant voltage can be displayed on the hidden display line.

In another arrangement, the step of setting at least one of the plurality of column electrodes to a substantially constant voltage can include the steps of, prior to activating the subsequent row electrode, applying a pulse to a terminal connected to at least one switch in which the pulse activates the switch and setting the plurality of column electrodes to the substantially constant voltage through the at least one switch.

The present invention also concerns a system for reducing the effect of column memory. The system includes a controller that is programmed to activate one of a plurality of row electrodes, a switch control to selectively apply a video input signal to a plurality of column electrodes, and structure to set at least one of the plurality of column electrodes to a substantially constant voltage prior to the controller activating a subsequent row electrode. The system also includes suitable software and circuitry to implement the methods as described above.

DETAILED DESCRIPTION OF THE PREFERRED EMBODIMENTS

Figure 1:
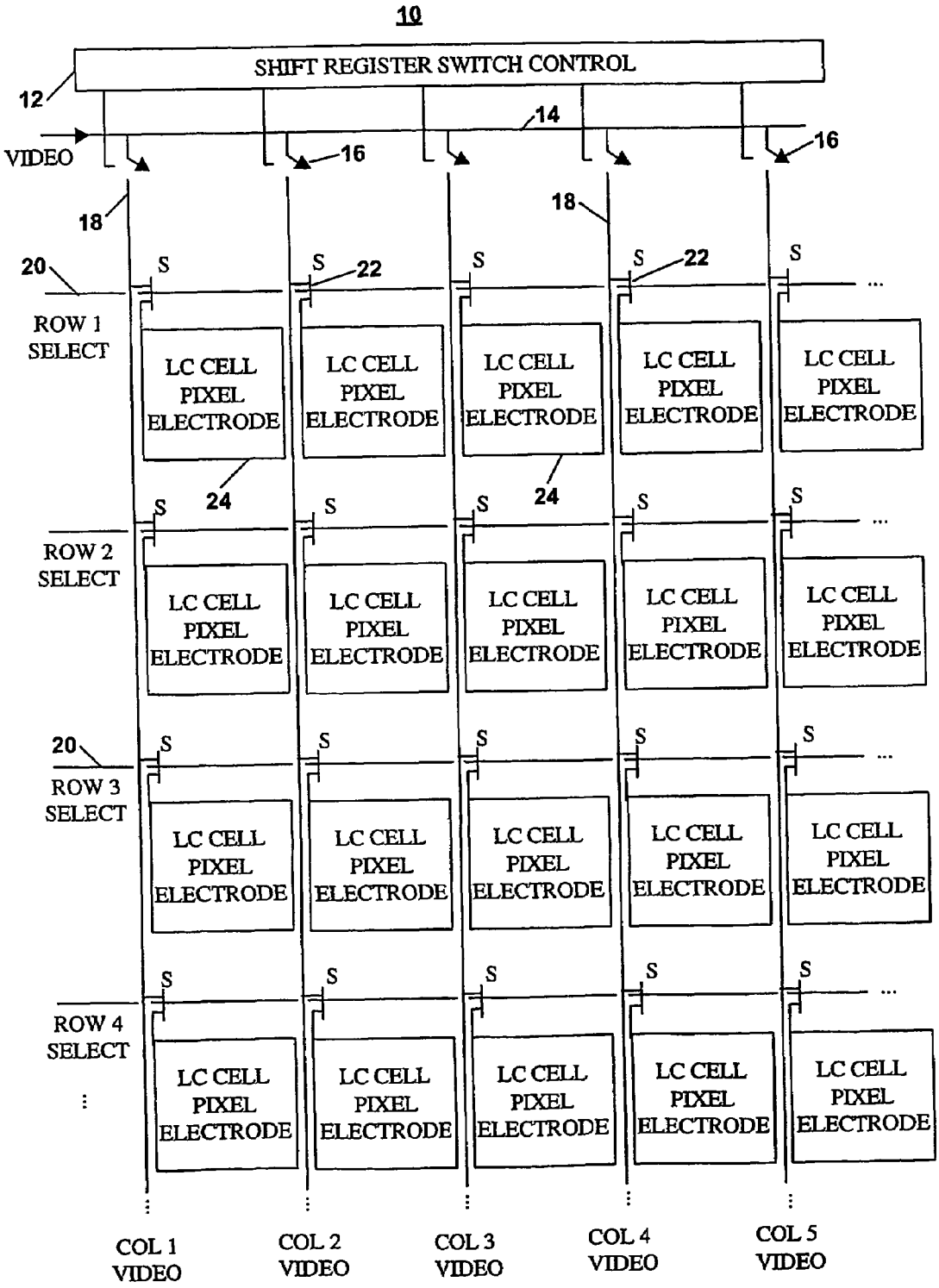
FIG. 1 illustrates a portion of an LCOS imager.

Referring to FIG. 1, a portion of an imager 10 commonly found in many LCOS display devices is illustrated. The imager 10 can include a switch control 12 such as a shift register switch control, a video bus 14, one or more switches 16 coupled to a plurality of column electrodes 18 and a plurality of row electrodes 20. The imager 10 can also include a plurality of switches 22 (the reference letter "S" denotes switch) coupled to a plurality of liquid crystal (LC) cell pixel electrodes 24. It is important to note that while FIG. 1 shows only five column electrodes 18 and four row electrodes 20, practical imagers 10 will typically have many more column electrodes 18, row electrodes 20 and pixel electrodes 24.

A controller (not shown) can activate the row electrodes 20 one at a time to enable video to be written to a particular row of pixels, also referred to as a row for convenience. The controller can activate a row electrode 20 by applying a control voltage to the row electrode 20. When a row electrode 20 is activated, the switches 22 coupled to the row electrode 20 being activated can be turned on.

The switch control 12 can control the operation of the switches 16. Once a row electrode 20 is activated and the corresponding switches 22 are turned on, the switches 16 can be selectively closed to permit a video input signal on the video bus 14 to be transferred to the corresponding column electrode 18 and on to the corresponding pixel electrode 24. The operation of the switches 16 is generally sequentially exclusive. That is, only one of the switches 16 is closed at any particular time as the switches 16 are closed and subsequently opened in a sequential or consecutive fashion, although the present invention is not necessarily limited in this regard.

The charge on a column electrode 18 from the video input signal, however, remains on the column electrode 18 after the corresponding switch 16 is opened. Consequently, as the next row electrode 20 is selected, this residual charge, i.e., column memory, will be added to the charge from the incoming video input signal thereby possibly resulting in the ghosting effect.

LCOS Column Memory Effect Reduction

Figure 2:
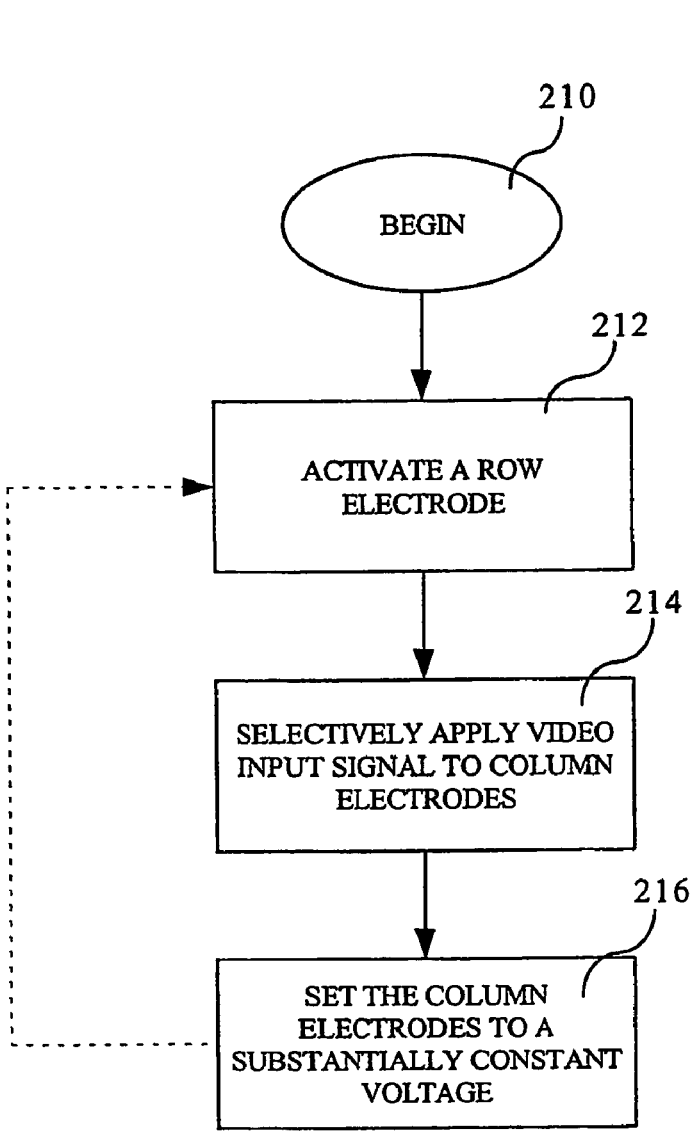
FIG. 2 illustrates a method for reducing the effects of column memory in an imager in accordance with the inventive arrangements.

A method 200 for reducing the effect of column memory is illustrated in FIG. 2. This method 200 can be used to reduce the effects of column memory in the imager 10 of FIG. 1. The invention, however, is not limited in this regard, as the method 200 can be used to reduce the effects of column memory in any other suitable display device. At step 210, the method 200 can begin. At step 212, a row electrode 20 can be activated. In one arrangement, the row electrode 20 can be associated with an active display line, or a line of pixels that, when illuminated, can be seen by a viewer. It is understood, however, that the invention is not so limited, as the row electrode 20 can be associated with any other suitable display line in an imager. A video input signal can be selectively applied to the column electrodes 18, as shown at step 214. At step 216, prior to activating a subsequent row electrode 20, one or more of the column electrodes 18 can be set to a substantially constant voltage.

Setting the column electrodes 18 to a substantially constant voltage can help reduce the effects of column memory because the charge that results from this setting step affects the brightness of the pixels in the selected row in a substantially uniform manner. As an example, the substantially constant voltage can be a voltage typically produced when a set of pixels have the same brightness, commonly referred to as a flat field. A flat field generally contains no picture detail, and examples of a flat field include a set of pixels written with all white, all black or all gray video. In fact, a flat field can include any video having a substantially constant brightness. Because no picture detail results from a substantially constant voltage being applied to the column electrodes 18, setting the column electrodes 18 to the substantially constant voltage can reduce the ghosting effect resulting from column memory.

The substantially constant voltage can be any voltage so long as it is substantially constant. Thus, substantially constant can be either a positive or negative voltage or even zero. For purposes of the invention, the term "substantially constant voltage" can include absolute constant or slight or even moderate deviations therefrom. Continuing with the method 200, steps 212, 214 and 216 can be repeated. It is important to note that the activation of at least a portion of subsequent row electrodes 20 can be performed in a sequential manner, i.e., the next consecutive or adjacent row electrode 20 can be activated, or in a non-sequential manner, i.e., a jump can be made to any other suitable non-consecutive or non-adjacent row electrode 20.

Figure 3:
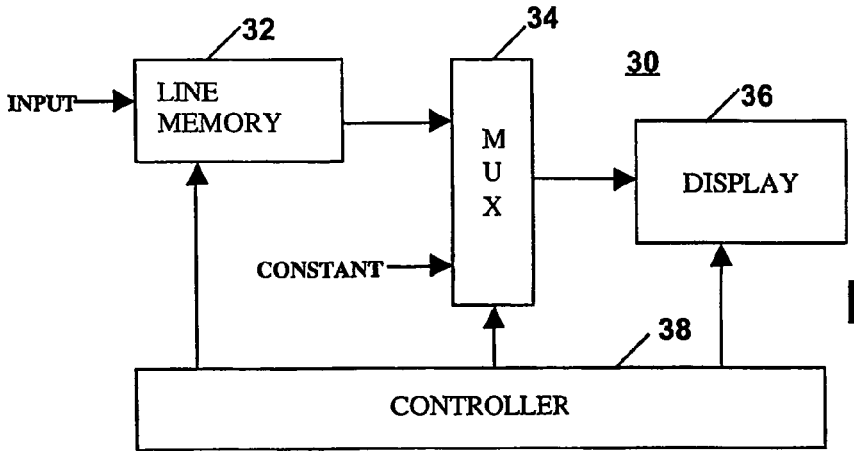
FIG. 3 illustrates an example of a system that can be used to set at least one of a plurality of column electrodes to a substantially constant voltage in accordance with the inventive arrangements.
Figure 4:
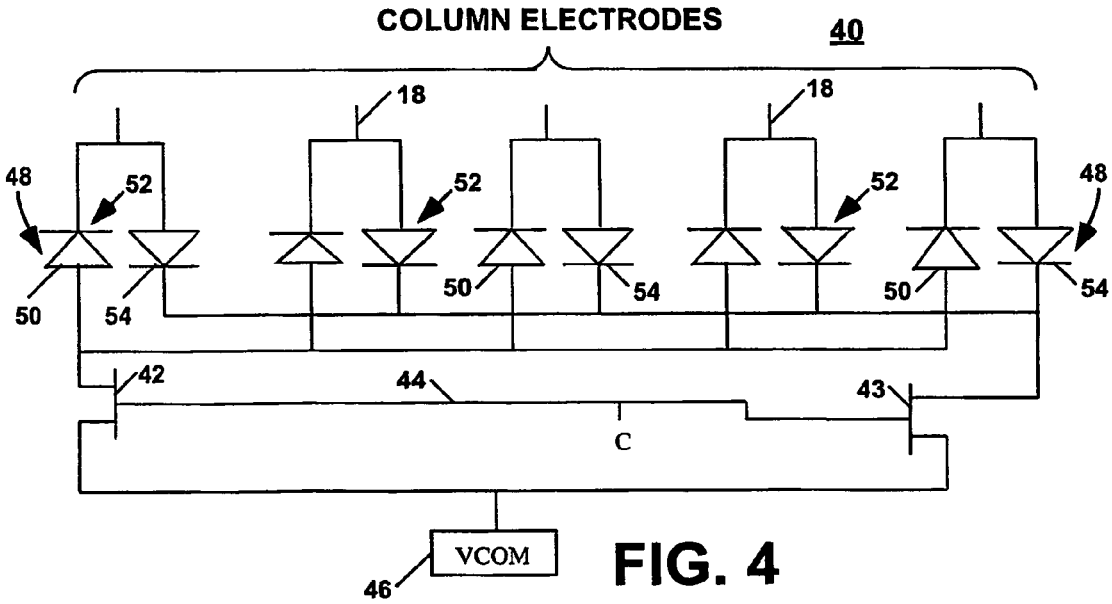
FIG. 4 illustrates another example of a system that can be used to set at least one of a plurality of column electrodes to a substantially constant voltage in accordance with the inventive arrangements.
Figure 5:
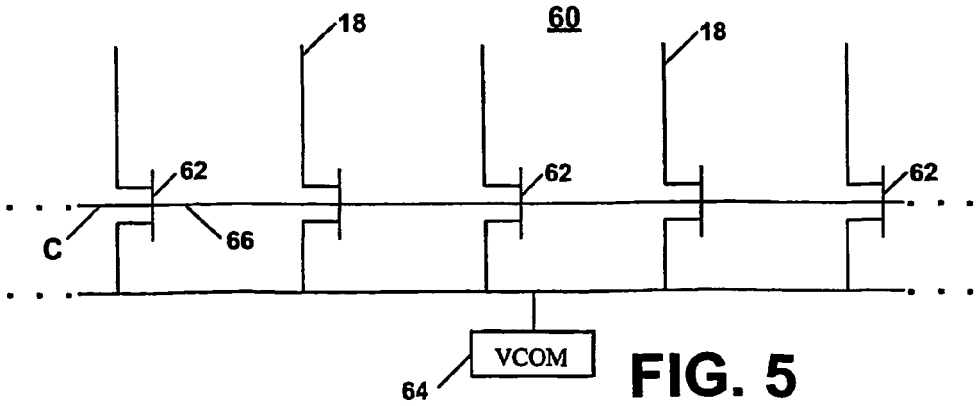
FIG. 5 illustrates yet another example of a system that can be used to set at least one of a plurality of column electrodes to a substantially constant voltage in accordance with the inventive arrangements.

There are several different ways to carry out step 216 in which at least one of the column electrodes 18 is set to a substantially constant voltage. Three such examples are shown in FIGS. 3-5. Referring to FIG. 3, a system 30 can be used to set the column electrodes 18 (in FIG. 1) to a substantially constant voltage. The system 30 can include a memory 32 and a multiplexer 34. The output of the multiplexer 34 can be sent to a display 36, which can include the imager 10 (not shown) from FIG. 1. A controller 38 can be used to control the operation of the memory 32, the multiplexer 34 and the display 36.

The video input signal can be written to the memory 32. The video input signal can also be transferred to the multiplexer 34. A substantially constant voltage signal can also be an input to the multiplexer 34. As such, the multiplexer 34, under the control of the controller 38, can alternately transmit the video input signal and the substantially constant voltage signal to the display 36. To permit this transfer, the video input signal can be read from the memory 32 at approximately double the speed at which the video input signal is written into the memory 32.

In operation, the controller 38 can activate a row electrode 20 (see FIG. 1) in the display 36, and the controller 38 can signal the switch control 12 (see FIG. 1) to selectively apply the video input signal to the column electrodes 18 through the switches 16 (see FIG. 1). Prior to the controller 38 activating the next row electrode 20, however, the substantially constant voltage signal can be applied to at least one of the column electrodes 18 experiencing the column memory effect. Thus, as the controller 38 activates a subsequent row electrode 20 for the next row to receive the video input signal stored in the memory 32, the residual charge or column memory on the column electrodes 18 can be substantially constant. In one arrangement, the substantially constant voltage signal can be applied to all the column electrodes 18 prior to the controller 38 activating the next row electrode 20.

If the imager 10 being used requires that the substantially constant voltage signal be written to a row of cells, then, in one arrangement, the controller 38 can activate a row electrode 20 associated with a hidden display line, or a line of pixels that, when illuminated, cannot be seen by a viewer. As a result, the substantially constant brightness corresponding to the substantially constant voltage signal can be written to the hidden display line. This process can prevent the substantially constant voltage signal from interfering with an active display line, which would erase the desired pixels in the selected row.

Nevertheless, the substantially constant voltage signal can be written to a row associated with an active display line such as a display line that is at the top or bottom of the portion of the display that a viewer sees. Of course, if the imager 10 does not require the substantially constant voltage signal to be written to a row, then the substantially constant voltage signal can be applied to the column electrodes 18 without changing any pixels.

Referring to FIG. 4, a system 40 can be used to set at least one of the plurality of column electrodes 18 to a substantially constant voltage. The system 40 can include switches 42, 43 coupled to a terminal 44 and a common voltage source 46 having a substantially constant voltage. The column electrodes 18 can be coupled to one or more diode pairs 48 in which switch 42 can be coupled to an anode 50 of one or more diodes 52 that comprise the diode pairs 48. Similarly, switch 43 can be coupled to a cathode 54 of one or more of the diodes 52. The controller 38 (see FIG. 3) can provide a pulse to the terminal 44 to turn on the switches 42, 43 intermittently.

In operation, a row electrode 20 (see FIG. 1) can be activated, and the video input signal can be selectively applied to the column electrodes 18 such that the residual charge remains on the column electrodes 18. Subsequently, the controller 38 can deactivate the switches 22 (see FIG. 1), i.e., remove the control voltage that was previously applied to the switches 22. As a result, the switches 22 can be open. The controller 38 can then provide the pulse to the terminal 44 prior to the next row electrode 20 being activated. This pulse can temporarily turn on the switches 42, 43. If the residual charge on a column electrode 18 creates a potential that is lower than the substantially constant voltage on the common voltage source 46, then the system 40 can set the column electrode 18 to the substantially constant voltage through the switch 42 and the appropriate diode 52.

Conversely, if the residual charge creates a potential that is greater than the substantially constant voltage, then the system 40 can set the column electrode 18 to the substantially constant voltage through the switch 43 and the appropriate diode 52. Similar to the system 30 discussed in relation to FIG. 3, the substantially constant voltage is not limited to any particular value. It is also important to note that the invention is not limited to the particular configuration shown in FIG. 4, as other suitable configurations that employ the same concept as described in relation to FIG. 4 can be used to set the column electrodes 18 to a substantially constant voltage.

Referring to FIG. 5, a system 60 is illustrated that is similar to the system 40 in FIG. 4 in certain respects. In system 60, one or more switches 62 can be coupled to at least one of the plurality of column electrodes 18 and a common voltage source 64 having a substantially constant voltage. The switches 62 can also be coupled to a terminal 66 that can receive a pulse from the controller 38 (see FIG. 3). Like system 30, the pulse can temporarily turn on the switches 62 and the pulse can be received prior to a subsequent row electrode 20 (not shown) being activated.

Once the switches 62 are on, if the voltage on a column electrode 18 is greater or lower than the substantially constant voltage, then the system 60 can set the column electrode to the substantially constant voltage provided by the common voltage source 64 through the appropriate switch 62. The substantially constant voltage is not limited to any particular value. Moreover, the invention is not limited to the particular configuration shown in FIG. 5, as other suitable configurations that employ the same concept as described in relation to FIG. 5 can be used to set the column electrodes 18 to a substantially constant voltage.

Although the present invention has been described in conjunction with the embodiments disclosed herein, it should be understood that the foregoing description is intended to illustrate and not limit the scope of the invention as defined by the claims.

What is claimed is:

1. A method for reducing the effect of column memory in a video imager, comprising the steps of:

activating one of a plurality of row electrodes;

selectively applying a video input signal to a plurality of column electrodes;

setting at least one of the plurality of column electrodes to a substantially constant voltage prior to activating a subsequent row electrode;

wherein said step of setting at least one of the plurality of column electrodes to a substantially constant voltage further comprises the steps of:

writing the video input signal to a memory;

activating the subsequent row electrode once the plurality of column electrodes are set to the substantially constant voltage;

selectively applying the video input signal from the memory to the plurality of column electrodes; and wherein said step of setting at least one of the plurality of column electrodes to a substantially constant voltage further comprises the step of activating a subsequent row electrode associated with a hidden display line such that a substantially constant brightness associated with the substantially constant voltage can be displayed on the hidden display line.

2. The method according to claim 1, wherein the substantially constant voltage correlates to a flat field.

3. The method according to claim 1, further comprising the steps of:

cyclically repeating the activating, selectively applying and setting steps; and, using said cyclically repeating steps to control a liquid crystal on silicon imager.

4. The method according to claim 3, wherein at least a portion of said activating steps is performed sequentially.

5. The method according to claim 3, wherein at least a portion of said activating steps is performed non-sequentially.

6. The method according to claim 1, wherein said activating step further comprises the step of activating a row electrode associated with an active display line.

7. The method according to claim 1, wherein said step of setting at least one of the plurality of column electrodes to a substantially constant voltage comprises the steps of:

prior to activating the subsequent row electrode, applying a pulse to a terminal connected to at least one switch, wherein the pulse activates the switch; and setting the plurality of column electrodes to the substantially constant voltage through the at least one switch.

8. A system for reducing the effect of column memory, comprising:

a controller, wherein the controller is programmed to activate one of a plurality of row electrodes;

a switch control to selectively apply a video input signal to a plurality of column electrodes;

a circuit for setting at least one of the plurality of column electrodes to a substantially constant voltage prior to the controller activating a subsequent row electrode;

wherein the structure further comprises:

a memory for storing the video input signal; and a multiplexer, wherein the controller is further programmed to activate the subsequent row electrode once the plurality of column electrodes are set to the substantially constant voltage, wherein the multiplexer feeds the video input signal from the memory to the switch control for selective application of the video input signal to the plurality of column electrodes; and an imager having display lines, wherein at least a portion of the display lines are hidden display lines, wherein the controller is further programmed to activate a subsequent row electrode associated with one of the hidden display lines such that a substantially constant brightness associated with the substantially constant voltage can be displayed on the hidden display line.

9. The system according to claim 8, wherein the substantially constant voltage correlates to a flat field.

10. The system according to claim 8, wherein the controller is further programmed to repeatedly activate one of the plurality of row electrodes, the switch control repeatedly applies the video input signal to the plurality of column electrodes and the structure repeatedly sets the plurality of column electrodes to the substantially constant voltage prior to the processor activating the subsequent row electrode, wherein the controller, the switch control and the structure are contained in a liquid crystal on silicon imager.

11. The system according to claim 10, wherein the controller is further programmed to activate at least a portion of the row electrodes sequentially.

12. The system according to claim 10, wherein the controller is further programmed to activate at least a portion of the row electrodes non-sequentially.

13. The system according to claim 8, further comprising an imager having active display lines, wherein the controller is further programmed to activate a row electrode associated with one of the active display lines.

14. The system according to claim 8, wherein the structure further comprises at least one switch connected to a terminal and a common voltage source storing the substantially constant voltage, wherein, prior to activating the subsequent row electrode, the controller is further programmed to apply a pulse to the terminal, wherein the pulse activates the switch, wherein the common voltage source sets the plurality of column electrodes to the substantially constant voltage through the at least one switch.

15. A method for reducing the effect of column electrode memory in a video imager, comprising the steps of:

activating one of a plurality of row electrodes;

selectively applying a first video input signal through a plurality of column electrodes to a plurality of pixel electrodes arranged in a row;

subsequent to the step of selectively applying the first video input signal, deactivating the one of said plurality of row electrodes; and subsequent to the deactivating step, setting at least one of the plurality of column electrodes to a substantially constant voltage prior to activating a subsequent one of said plurality of row electrodes;

subsequent to the setting step, selectively applying a second video input signal through the plurality of column electrodes to the plurality of pixel electrodes arranged in a row;

subsequent to the step of selectively applying a second video input signal, activating the subsequent one of said plurality of row electrodes.

16. The method according to claim 15, wherein the substantially constant voltage correlates to a flat field.

17. The method according to claim 15, further comprising the steps of:

cyclically repeating the steps of activating the one of said plurality of row electrodes, selectively applying the first video input signal, deactivating, setting, selectively applying the second video input signal, and activating the subsequent one of said plurality of row electrodes; and using said cyclically repeating steps to control a liquid crystal on silicon imager.

18. The method according to claim 17, wherein at least a portion of said activating steps is performed sequentially.

19. The method according to claim 17, wherein at least a portion of said activating steps is performed non-sequentially.

20. The method according to claim 15, wherein said activating step further comprises the step of activating a row electrode associated with an active display line.

21. The method according to claim 15, wherein said step of setting at least one of the plurality of column electrodes to a substantially constant voltage further comprises the steps of:

writing the video input signal to a memory;

activating the subsequent row electrode once the plurality of column electrodes are set to the substantially constant voltage; and selectively applying the video input signal from the memory to the plurality of column electrodes.

22. The method according to claim 21, wherein said step of setting at least one of the plurality of column electrodes to a substantially constant voltage further comprises the step of activating a subsequent row electrode associated with a hidden display line such that a substantially constant brightness associated will the substantially constant voltage can be displayed on the hidden display line.

23. The method according to claim 15, wherein said step of setting the plurality of column electrodes to a substantially constant voltage comprises the steps of:

prior to activating the subsequent row electrode, applying a pulse to a terminal connected to at least one switch, wherein the pulse activates the switch; and setting the plurality of column electrodes to the substantially constant voltage through the at least one switch.

24. A system for reducing the effect of column electrode memory, comprising:

a controller, wherein the controller is programmed to activate or deactivate one of a plurality of row electrodes;

a switch control to selectively apply a first video input signal through a plurality of column electrodes to a plurality of pixel electrodes arranged in a row; and a circuit for setting the plurality of column electrodes to a substantially constant voltage prior to the controller activating a subsequent one of said plurality of row electrodes, wherein the switch control is configured to selectively apply the second video input signal through the plurality of column electrodes prior to the controller activating the subsequent one of said plurality of row electrodes.

25. The system according to claim 24, wherein the substantially constant voltage correlates to a flat field.

26. The system according to claim 24, wherein the controller is further programmed to repeatedly activate one of the plurality of row electrodes, the switch control repeatedly applies the video input signal to the plurality of column electrodes and the structure repeatedly sets the plurality of column electrodes to the substantially constant voltage prior to the processor activating the subsequent one of said plurality of row electrodes, wherein the controller, the switch control and the structure are contained in a liquid crystal on silicon imager.

27. The system according to claim 26, wherein the controller is further programmed to activate at least a portion of the row electrodes sequentially.

28. The system according to claim 26, wherein the controller is further programmed to activate at least a portion of the row electrodes non-sequentially.

29. The system according to claim 24, further Comprising an imager having active display lines, wherein the controller is further programmed to activate a row electrode associated with one of the active display lines.

30. The system according to claim 24, further comprising:

a memory for storing the video input signal; and a multiplexer, wherein the controller is further programmed to activate the subsequent one of said plurality of row electrodes once the plurality of column electrodes are set to the substantially constant voltage, wherein the multiplexer feeds the video input signal from the memory to the switch control for selective application of the video input signal to the plurality of column electrodes.

31. The system according to claim 30, further comprising an imager having display lines, wherein at least a portion of the display lines are hidden display lines, wherein the controller is further programmed to activate a subsequent row electrode associated with one of the hidden display lines such that a substantially constant brightness associated with the substantially constant voltage can be displayed on the hidden display line.

32. The system according to claim 24, wherein the structure further comprises at least one switch connected to a terminal and a common voltage source storing the substantially constant voltage, wherein, prior to activating the subsequent row electrode, the controller is further programmed to apply a pulse to the terminal, wherein the pulse activates the switch, wherein the common voltage source sets the plurality of column electrodes to the substantially constant voltage through the at least one switch.

* * * * *